United States Patent [19]

Budinsky et al.

[11] Patent Number: 4,469,526

[45] Date of Patent: Sep. 4, 1984

[54] SYSTEM FOR REMOVING ADHERING LIQUID FROM OBJECTS AFTER A GALVANIC OR CHEMICAL SURFACE TREATMENT

[75] Inventors: Helmut Budinsky, Winkelhaid; Horst Bläsing, Berlin, both of Fed. Rep. of Germany

[73] Assignee: Schering Aktiengesellschaft, Berlin & Bergkamen, Fed. Rep. of Germany

[21] Appl. No.: 408,663

[22] Filed: Aug. 16, 1982

[30] Foreign Application Priority Data

Aug. 21, 1981 [DE] Fed. Rep. of Germany ..... 3133629

[51] Int. Cl.[3] ..... B08B 5/02; B08B 7/04

[52] U.S. Cl. ..... 134/25.4; 15/305; 134/30; 134/33; 134/37; 134/135; 134/199; 134/200; 204/213

[58] Field of Search ..... 134/25.4, 30, 32, 37, 134/135, 199, 200, 33; 15/305; 204/213

[56] References Cited

U.S. PATENT DOCUMENTS

| | | | |
|---|---|---|---|
| 2,194,565 | 3/1940 | Moss | 134/37 X |
| 3,286,718 | 11/1966 | Kumpf | 134/135 X |
| 3,734,108 | 5/1973 | Almegard et al. | 134/135 X |
| 4,033,785 | 7/1977 | Gibbs | 134/37 X |

*Primary Examiner*—Marc L. Caroff

*Attorney, Agent, or Firm*—Michael J. Striker

[57] ABSTRACT

Cleaning of objects from adhering liquid surface treating medium after galvanic and/or chemical surface treatment and recovery of the liquid medium is performed by lifting objects treated in a working container by a drum aggregate, bringing two half shells over the drum aggregate to embrace the latter so that at only a lower region of the drum aggregate a gap remains, and blowing a gas stream through the half shells to the drum aggregate so that an adhered treating medium is removed from the objects and flows directly back to the working container through the gap.

18 Claims, 2 Drawing Figures

SYSTEM FOR REMOVING ADHERING LIQUID FROM OBJECTS AFTER A GALVANIC OR CHEMICAL SURFACE TREATMENT

BACKGROUND OF THE INVENTION

The present invention relates to an arrangement and a method for cleaning objects from adhering liquid surface treating media after galvanic and/or chemical surface treatment and its recovery.

More particularly, it relates to an arrangement and a method for cleaning of objects from adhering liquid surface treating media after galvanic and/or chemical surface treatment and their recovery with conveying means, travelling carriages, treatment station, drum aggregate with perforated walls, treatment container, water connections and gas advantageously air connections, and connected tubular conduits.

Arrangements and methods for cleaning objects from adhering liquid surface treating media and their recovery are known in the art. This recovery is required since, for example, during mass galvanization in galvanization drums with the treatment goods and the galvanization drum considerable quantities of the treatment liquid are dragged out, rinsed in subsequent rinsing steps, and thereby nullified as a material to be used, inasmuch as the concentration is too small to apply to the bath. With the conventional connected-in-series stand rinse baths, a part of the useful material can be supplied for compensation of evaporation losses of the treatment bath, whereas the greater part of the useful material is further supplied to the decontamination means and thereby results in further expenses. Another arrangement for eliminating these disadvantages is proposed in German Offenlegungsschrift No. 2,758,550. In this arrangement the treatment medium is removed by aspiration. Since the aspiration process is performed in a chamber which is arranged separately from the treatment container, the aspirating medium must be supplied back via conduits into the treatment bath, whereby technical expenses are increased.

It is also known in the art to withdraw the treatment solutions at least partially from the object by blowing with pressurized air. This method cannot, however, be utilized for objects accommodated in drum aggregates, inasmuch as the liquid treatment medium is sprayed into the surrounding atmosphere and can be recovered only with high technical expenditures for special aspirating devices, and further the recovery can be only very incomplete.

SUMMARY OF THE INVENTION

Accordingly, it is an object of the present invention to provide an arrangement for and a method of cleaning objects from adhering liquid treating media and their recovery, which avoid the disadvantages of the prior art.

More particularly, it is an object of the present invention to provide an arrangement and a method which allow cleaning objects of adhering liquid surface treatment media and their direct recovery in a treatment container.

In keeping with these objects, and with others which will become apparent hereinafter, one feature of the present invention resides, briefly stated, in an arrangement which has a working container, a drum aggregate arranged for accommodating articles to be treated and movable between two positions inside and outside of the working container, and two half shells arranged to embrace the drum aggregate so that a gap remains only in a lower region of the latter, whereby an adhered treating medium is removed from the object by a gas stream flowing through the half shells to the drum aggregate and directly flows back to the working container through the gap.

In accordance with another advantageous feature of the present invention, the half shells of the inventive arrangement are provided with openings for blowing a gas stream therethrough, advantageously formed as slots. Air streams can be used as the above mentioned gas.

Still another feature of the present invention is that at least one of the half shells is provided with openings for flowing a rinsing water therethrough.

A further feature of the present invention is that the drum aggregate is provided at both its end walls with rotation-symmetrical edges.

Still a further feature of the present invention is that the arrangement can be arranged stationary in one treatment station or can be brought by a travelling carriage for several treatment stations.

Another feature of the present invention is a method of cleaning objects of adhering liquid surface treating media, in accordance with which objects treated in a working container is lifted from the latter by a drum aggregate, two half shells are brought above the drum aggregate to embrace the latter so that only in a lower region of the drum aggregate does a gap remain, and a gas stream is blown through the half shells to the drum aggregate so that an adhered treating medium is removed and flows directly back to the working container through the gap.

Yet another feature of the present invention is that the working container rotate during the blowing step, advantageously in an intermittent manner.

A further feature of the present invention is that the gas stream exits from openings provided in the half shells with a pressure of approximately 0.4 bar.

An additional feature of the present invention is that a water rinsing of the objects can take place before the gas stream blowing or simultaneously with the latter.

The rinsing is performed with devices which are provided in at least one half shell.

Finally, half shells are composed of inert material, advantageously a synthetic plastic material.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
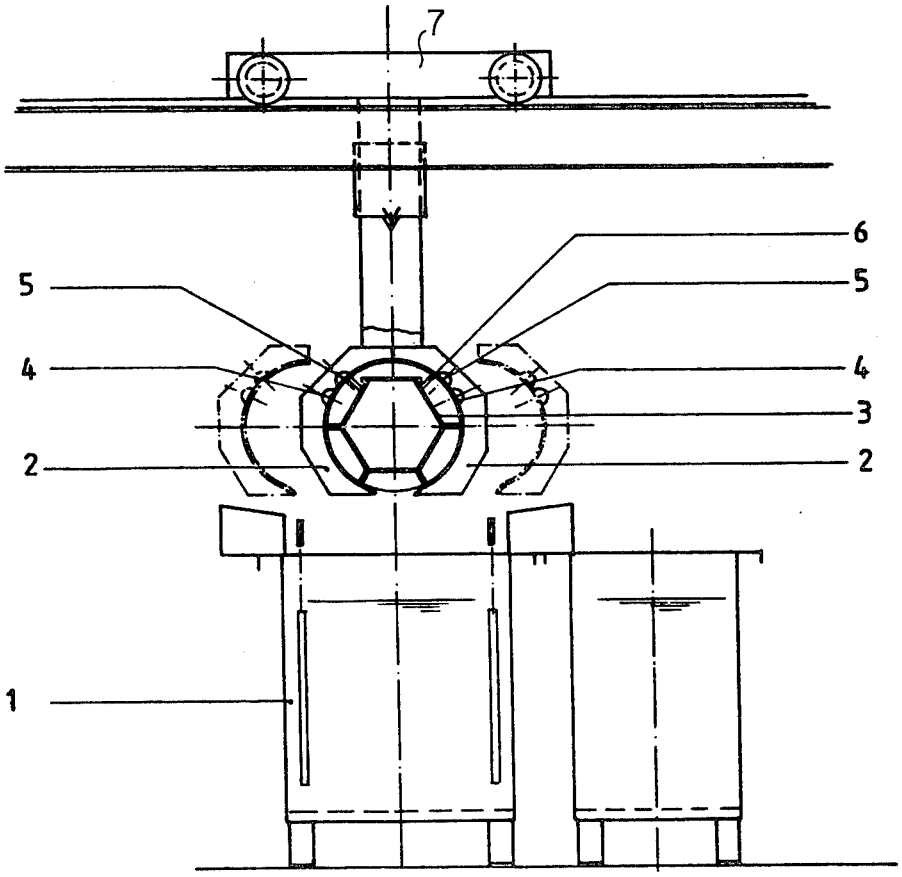
FIG. 1 is a side view of an arrangement for cleaning objects of adhering liquid surface treating medium and its recovery, in accordance with the present invention.
Figure 2:
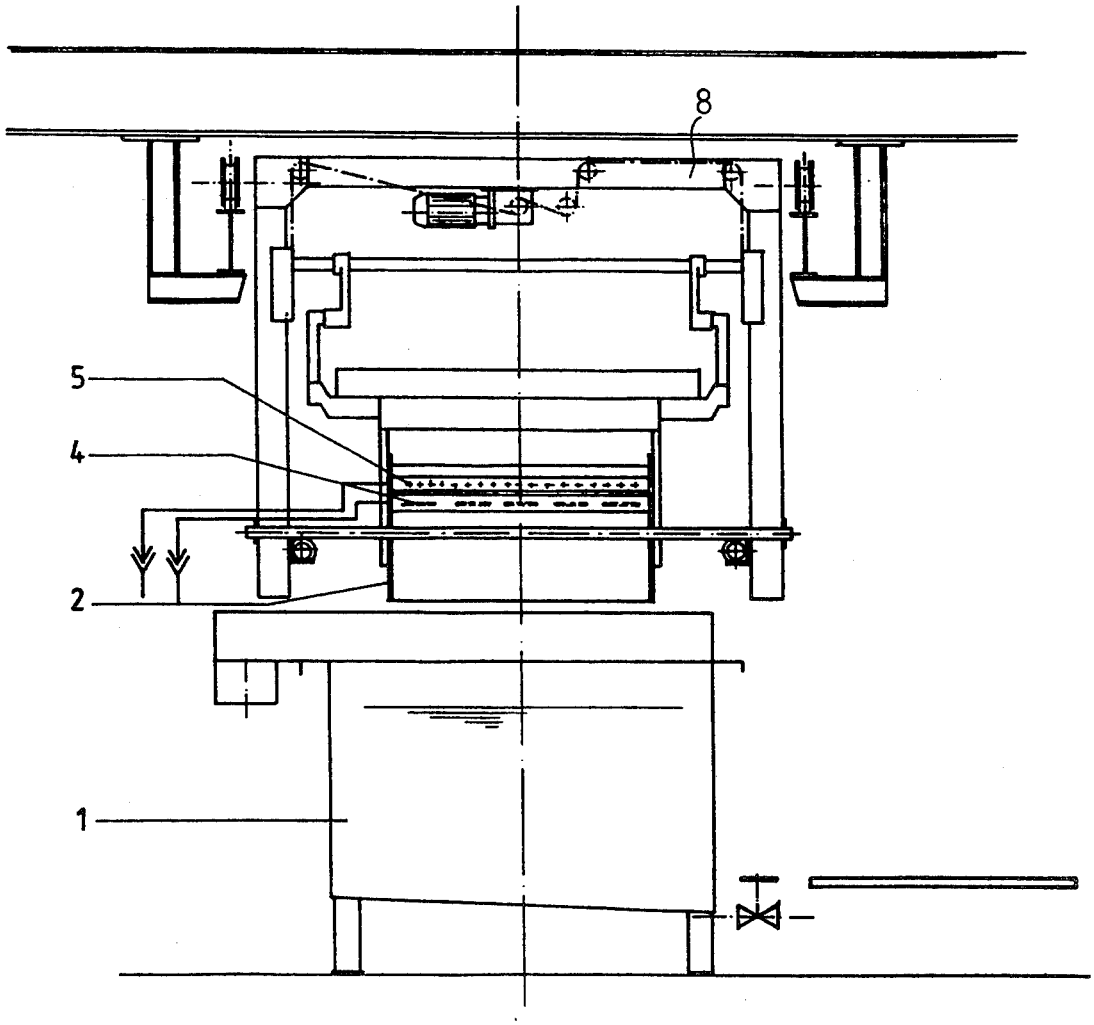
FIG. 2 is a plan view of the arrangement shown in FIG. 1.

An arrangement for cleaning objects from adhering liquid surface-treating medium and its recovery has a working container which is identified by reference numeral 1 and serves as a bath conventional for the desired purpose. In some cases it is protected against aggresive treatment media.

Two half shells identified by reference numeral 2 are composed of an inert material and can be additionally provided with reinforcing shaped members in correspondence with required shape stability. The periphery of the half shells 2 exactly corresponds to the periphery of a galvanization drum received in the half shells. A part of the half shells is double-head- or double-jaw-like.

The shells 2 are provided with openings 4 and 5 which are slot-shaped or nozzle-shaped. The liquid media are supplied through for example cross-shaped openings arranged in adjacent rows.

The gaseous media are supplied, for example, through slot-shaped openings arranged parallel in overlapping manner. The gas openings are arranged in the direction of rotation of the drum after the supply of the liquid media.

The half shells can be arranged for stationary mounting in one treatment station or can be brought by a traveling carriage 7 to a plurality of treatment stations.

A drum aggregate 3 is formed as a conventional drum, for example a hexagonal drum, with perforated walls. It can be a component of a drum support and arranged between two supporting arms. The drum aggregate is provided, for example, with rotation-symmetrical edges 6 at both its end walls, which provide for a sealing pertaining to narrow connection between the aggregate and the half shells.

Conventional materials can be utilized for the inventive arrangement, as long as they are resistant to aspirating service-treating media and do not disturb the purifying process. Generally, synthetic plastic materials or metals coated with synthetic plastic materials can be utilized in the inventive arrangement.

The implementation of the inventive method has no technical problems. The drum carrier 8 is lifted from the bath and held at the height of the half shells. The half shells which correspond to the shape of the drum are moved onto the drum and tightly embrace the latter. Air flows outwardly through the slots 4 with a pressure of approximately 0.4 bar and presses the liquid through the open part of the half shells in the lower region of the drum back into the bath. This process can be performed with the intermittently rotating drum and continue over approximately 50 seconds. Rinsing water is supplied out of the slots 5 with the quantity corresponding to the surface evaporation. This can be performed during 20–50 seconds. The shells are now moved away from the drum, the drum displaces upwardly and can be actuated for the next step.

It is advantageous that, in accordance with the present invention, both blowing and rinsing of the treated objects take place. After complete removal of the treating medium, drying by blowing with air can also be provided.

The utilization of the inventive method and arrangement makes it possible, in the event of treatment in an alkaline zinc bath, to recover by blowing over 60% of the zinc quantity dragged by the aggregate and the objects, and to increase the recovery by the subsequent rinsing to 100%.

The arrangement and method in accordance with the invention can be used for all galvanic and chemical surface treatment processes in which cleaning and recovery of watery surface treatment media or agents adhered on the objects is required or desired, drying can follow these steps. The arrangement and method in accordance with the present invention is particularly suitable for galvanic separation of chromium, nickel, cobalt, copper, cadmium, zinc, tin, lead, silver, gold, rhodium, palladium, and their alloys, with which an economical utilization and environmental requirements make desirable a maximum quantitative direct recovery of the valuable material.

The particular advantage of the inventive method is the direct recovery and the subsequent utilization of the surface treatment media. The inventive arrangement has low technical expenditures which is inversely proportional to the technical advantages obtained therefrom.

It will be understood that each of the elements described above, or two or more together, may also find a useful application in other types of constructions differing from the types described above.

While the invention has been illustrated and described as embodied in an arrangement for cleaning and recovery of galvanic or chemical treating media, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An arrangement for cleaning objects from adhering liquid surface-treating medium after galvanic and/or chemical surface treatment and recovery of the liquid medium, comprising a working container;

a drum aggregate for accommodating objects and means for moving said drum aggregate between two positions inside and outside of said working container;

two half shell means for embracing said drum aggregate in said outside position so that a gap between the shells remains only in a lower region of the drum aggregate; and means for supplying a gas stream through said half shells to said drum aggregate so as to remove the adhered treating medium from objects and directly flow the same back to said working container through said gap.

2. An arrangement as defined in claim 1, wherein said half shells are provided with openings for blowing a gas stream therethrough.

3. An arrangement as defined in claim 2, wherein said openings of said half shells for blowing a gas stream are formed as slots.

4. An arrangement as defined in claim 1, wherein at least one of said half shells embracing said drum aggregate has openings for flowing a rinsing liquid therethrough.

5. An arrangement as defined in claim 1, wherein said drum aggregate for accommodating objects has two end walls provided with rotation-symmetrical edges.

6. An arrangement as defined in claim 1; and further comprising means for stationary mounting said half shells in a treatment station.

7. An arrangement as defined in claim 1; and further comprising means for bringing said half shells to a plurality of treatment stations and including a travelling carriage.

8. An arrangement as defined in claim 1, wherein said half shells embracing said drum aggregate are composed of an inert material.

9. An arrangement as defined in claim 8, wherein said half shells embracing said drum aggregate are composed of synthetic plastic material.

10. A method of cleaning objects from adhering liquid surface treatment medium after galvanic and/or chemical surface treatment and recovery of the liquid medium, comprising the steps of accommodating objects to be treated in a drum aggregate;

lowering the drum aggregate into a working container of said liquid so as to contact the objects with said liquid;

lifting the drum aggregate out of the working container after treating the objects in the liquid;

bringing two half shells above the drum aggregate to embrace the latter so that only in a lower region of the drum aggregate a gap between the shells remains; and blowing a gas stream through the half shells to the drum aggregate so that adhered liquid treating medium is removed and flows directly back to the working container through the gap.

11. A method as defined in claim 10; and further comprising the step of rotating said drum aggregate during said gas stream blowing step.

12. A method as defined in claim 11, wherein said rotating step includes intermittently rotating said drum aggregate during said gas stream blowing step.

13. A method as defined in claim 10, wherein said half shells have openings for allowing the gas stream to flow therethrough; said blowing step including exiting the gas stream from the openings with a pressure of approximately 0.4 bar.

14. A method as defined in claim 10; and further comprising the step of water rinsing the objects prior to said gas stream blowing step.

15. A method as defined in claim 10; and further comprising the step of water rinsing the objects simultaneously with said gas stream blowing step.

16. A method as defined in claim 15, wherein said water rinsing step includes water rinsing by means provided in one of the half shells.

17. A method as defined in claim 10, wherein said half shells are composed of an inert material.

18. A method as defined in claim 17, wherein the half shells are composed of synthetic plastic material.

* * * * *